United States Patent [19]

Winters

[11] Patent Number: 4,671,517

[45] Date of Patent: Jun. 9, 1987

[54] APPARATUS FOR ROTATABLY MOUNTING ARROWHEADS

[76] Inventor: Danny J. Winters, 2104 Briscoe, Artesia, N. Mex. 88210

[21] Appl. No.: 590,217

[22] Filed: Mar. 16, 1984

[51] Int. Cl.[4] ..... F41B 5/02

[52] U.S. Cl. ..... 273/421; 403/165

[58] Field of Search ..... 273/416–423; 403/164, 165

[56] References Cited

U.S. PATENT DOCUMENTS

| | | | |
|---|---|---|---|
| 893,274 | 7/1908 | Starrett | 403/165 X |
| 2,651,488 | 9/1953 | Sauer | 403/165 X |
| 2,694,776 | 11/1954 | Wittman | 403/165 X |
| 3,401,938 | 9/1968 | Bear | 273/106.5 |
| 3,527,463 | 9/1970 | Turner | 273/106.5 |
| 3,865,437 | 2/1975 | Crosby | 403/165 X |
| 3,910,579 | 10/1975 | Sprandel | 273/422 |
| 3,945,642 | 3/1976 | Henthorn, Jr. | 273/106.5 R |
| 4,006,901 | 2/1977 | Simo | 273/106.5 B |
| 4,093,230 | 6/1978 | Simo | 273/106.5 B |
| 4,141,554 | 2/1979 | Sherwin | 273/421 X |
| 4,175,749 | 11/1979 | Simo | 273/106.5 B |
| 4,203,601 | 5/1980 | Simo | 273/421 |
| 4,381,866 | 5/1983 | Simo | 273/422 |
| 4,534,568 | 8/1985 | Tone | 273/421 |

FOREIGN PATENT DOCUMENTS 1194661 11/1959 France .

*Primary Examiner*—Paul E. Shapiro

*Attorney, Agent, or Firm*—Willian Brinks Olds Hofer Gilson & Lione, Ltd.

[57] ABSTRACT

An apparatus for rotatably mounting an arrowhead on an arrow shaft wherein a biasing force acts to keep the arrowhead in alignment with the arrow shaft. In one embodiment, the apparatus comprises a flanged support sleeve in the end of a hollow arrow shaft and an arrowhead connector, wherein the shank of the connector is retained in the support sleeve with a biasing force acting to pull the connector and attached arrowhead back against the flange of the support sleeve. The biasing force is of adjustable magnitude for use with arrowheads of differing weights.

17 Claims, 10 Drawing Figures

APPARATUS FOR ROTATABLY MOUNTING ARROWHEADS

BACKGROUND OF THE INVENTION

This invention relates to arrows, and more particularly to arrowhead adapters for interchangeably mounting arrowheads on an arrow shaft to provide freedom of rotation between the arrowhead and the arrow shaft.

Previous patents have disclosed the concept of rotatably mounting arrowheads on arrow shafts, especially when broadhead hunting arrowheads are used. For example, U.S. Pat. No. 3,527,463 (Turner) suggested the use of a freely shiftable flat bladed arrowhead. This design was suggested as an alternative to arranging the arrow fletching to cause the arrow to spin in flight. By allowing the blade to "weather vane", and thus not get caught by air currents, it was thought that spinning the arrow shaft would be unnecessary. A benefit of eliminating the arrow spin was that penetration into the target was improved because there would be no rotational inertia of the spinning arrow to dissipate, which would otherwise cause the arrow to twist as it penetrated the target.

Subsequent patents disclosed the concept of allowing the arrow to spin in flight, while providing for rotation between the arrow shaft and the arrowhead. The shaft could then continue to spin though the arrowhead stopped spinning as it penetrated the target, thus preventing the effects caused by dissipation of the rotational inertia of the arrow shaft. One approach for accomplishing this was disclosed in U.S. Pat. No. 3,910,579 (Sprandel) which disclosed an arrowhead that could be mounted to swivel on a hollow arrow shaft or, as an alternative, an adapter that could be used to mount an old style broadhead so as to swivel on the shaft. Another approach, disclosed in U.S. Pat. Nos. 4,006,901, 4,093,230, 4,175,749, and 4,203,601 (Simo), included the concept of using a special broadhead constructed so that the blades can rotate around the central shaft structure of the arrowhead itself.

Old style broadheads are partially hollow, designed to fit over and be glued to the end of a solid arrow shaft. Modern broadheads are usually designed with externally threaded shanks for use with hollow shafts. Most modern archers purchase tubular arrow shafts, appropriately sized, and mount internally threaded inserts in the front end of the shafts. Thereafter, arrowheads can be interchangeably screwed into the shaft insert. This arrangement is an improvement over old style arrowheads because arrowhead alignment, essential for proper arrow flight, is more easily achieved. The archer no longer need rely on steady hands and patience to glue the arrowhead squarely on the front of the shaft.

There are commonly available adapters for converting old style arrowheads for use with modern tubular shafts and inserts. Once properly secured onto such an adapter, an old style arrowhead can be interchanged with modern arrowheads on modern arrow shafts.

The Simo device is commercially available, marketed under the trade name of "Razorbak" but the Sprandel apparatus never achieved widespread use. One problem with the Simo device is that an archer is limited to using broadheads of the design sold incorporating the patented device. Hunters cannot use their own broadheads, which they might prefer. The same problem existed for the Sprandel arrowhead.

One problem encountered with the Sprandel adapter is that it is designed for old style broadheads. There is no way to use the Sprandel device with modern arrowheads having externally threaded shanks. Perhaps more importantly, the Sprandel device suffers from a problem common to many devices that allow for freedom of rotation between the arrow shaft and arrowhead. The freedom of rotation is achieved by allowing some freeplay between the rotating parts, and thus there is a tendency for the arrowhead to droop or shift out of alignment, especially when the arrow is whipped as it is released from the bow. When broadheads are used, this lack of alignment is critical because the surface area of the blades creates a "sail" area, which affects the flight of the arrow.

SUMMARY OF THE INVENTION

According to the present invention, an arrowhead is rotatably mounted on an arrow shaft with a connecting apparatus which includes means for generating a biasing force to keep the arrowhead in alignment. The invention can be embodied as an insert which is designed to accept the externally threaded shank of modern arrowheads.

Some of the advantages of the present invention include the fact that (1) the arrowhead is held in alignment on the end of the shaft but may still rotate separately from the shaft (2) the biasing force may be adjusted to allow the op degree of rotational freedom for the weight of the arrowhead typically used by the archer, (3) the invention can be used with any arrowhead, especially the modern style of broadheads, and (4) the invention is of relatively simple construction, making it economical to fabricate. These and other advantages will be discussed in detail hereinafter.

DETAILED DESCRIPTION OF THE PREFERRED EMBODIMENTS

Figures 1, 2, 3, 3A, 3B, 4:
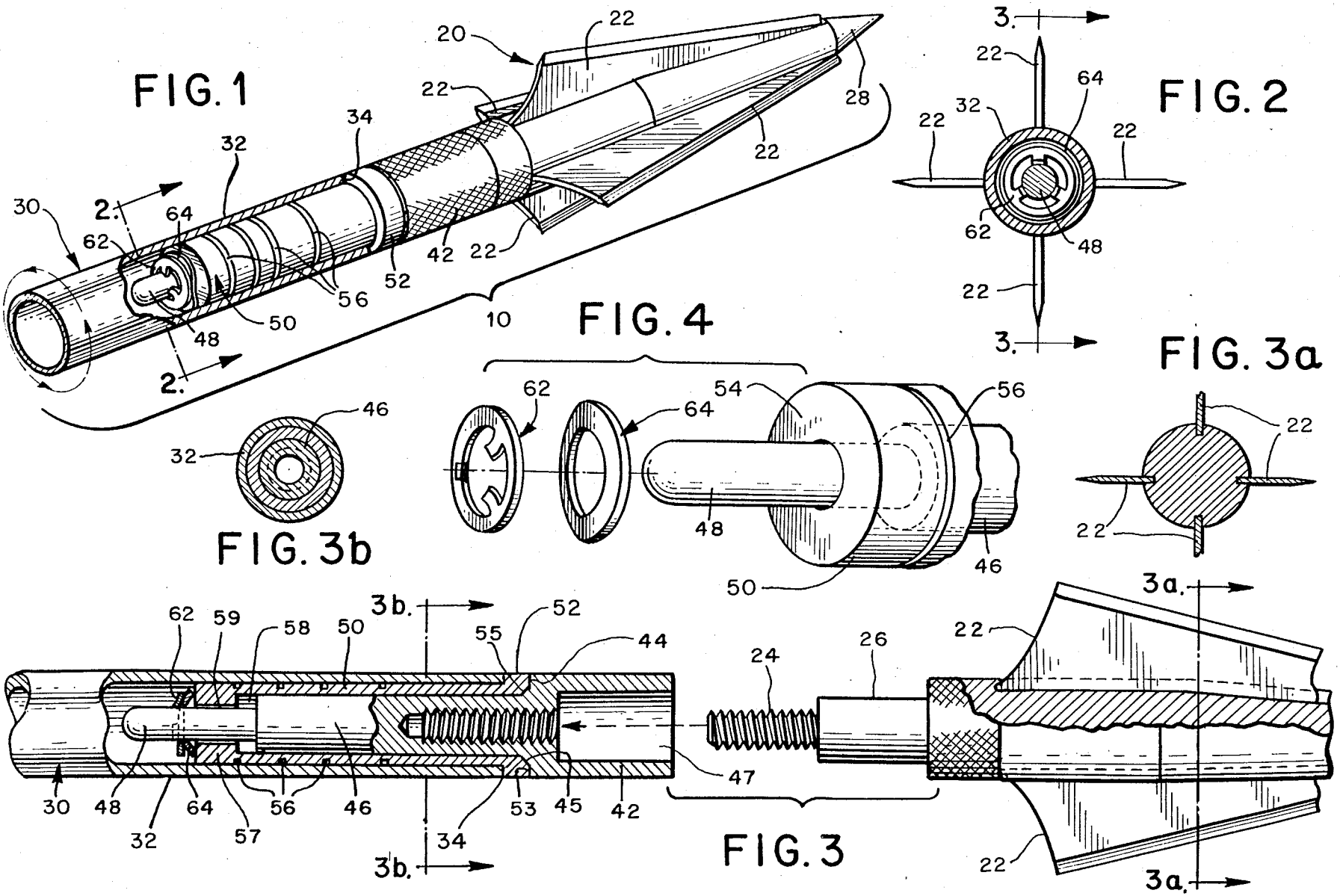
FIG. 1 is a perspective view in partial cutaway of the front end of an arrow which incorporates a presently preferred embodiment of the present invention.
FIG. 2 is a transverse sectional view taken along line 2—2 of FIG. 1.
FIG. 3 is a longitudinal sectional view taken along line 3—3 of FIG. 2.
FIG. 3*a* is a transverse sectional view taken along line 3*a*—3*a* of FIG. 3.
FIG. 3*b* is a transverse sectional view taken along line 3*b*—3*b* of FIG. 3.
FIG. 4 is an exploded perspective view of the rear portion of the preferred embodiment of FIG. 1.

FIG. 1 of the drawings shows the front portion of an arrow 10, equipped with a broadhead arrowhead 20 with blades 22 and tip 28. The arrow shaft 30 is shown partially cut away, revealing a hollow arrow shaft tube 32. Within the tube 32 at the front hollow end of the shaft is shown an insert which is the presently preferred embodiment of the present invention. FIG. 2 shows four blades 22 spaced at 90° angles about the center of the arrowhead. Any arrowhead configuration may be used with the present invention, though it is particularly suited to broadheads.

Figure 5:
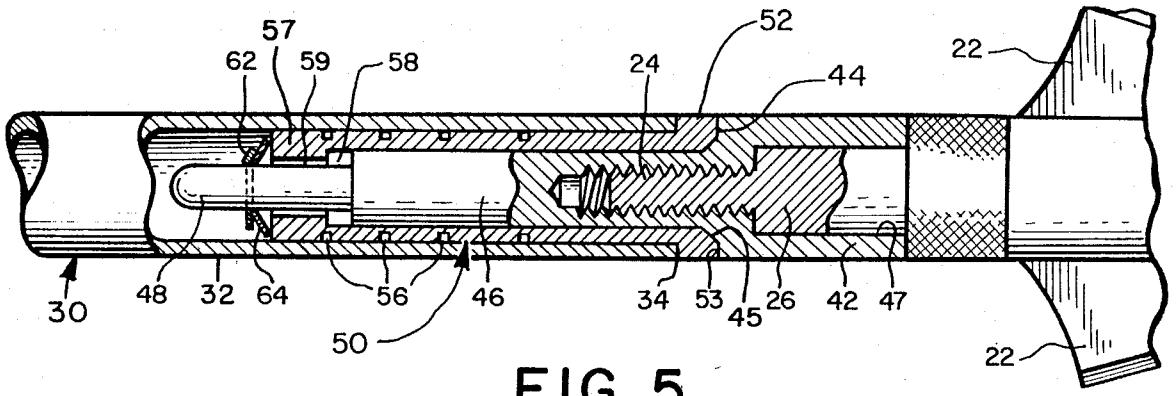
FIG. 5 is a sectional view corresponding to FIG. 3 showing the assembled arrow of FIG. 1.
Figure 6:
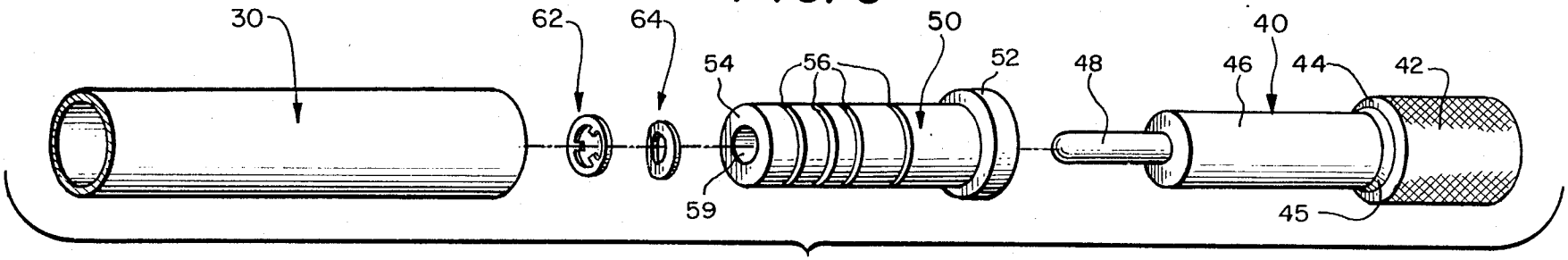
FIG. 6 is an exploded perspective view of the preferred embodiment of FIG. 1.
Figure 8:
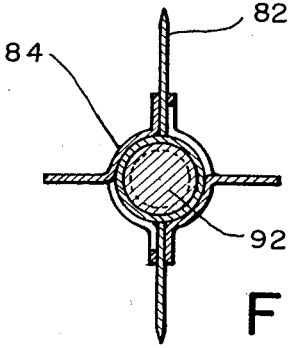
FIG. 8 is a transverse sectional view taken along line 8—8 of FIG. 7.

The insert comprises several component parts, best shown in FIGS. 3, 5 and 6, including an arrowhead connector 40 and an arrow shaft support sleeve 50. The support sleeve 50 has a flanged front 52 which fits over the front edge 34 of the arrow shaft and conveys thrust forces between the arrowhead connector 40 and the shaft 30. The outside of the support sleeve 50 is sized to fit snuggly inside the tube 32 of the arrow shaft 30, different size sleeves being required for different inside diameter tubes. The support sleeve 50 has an outside scored surface. The scoring lines 56 act with an adhesive to hold the sleeve 50 in a fixed, concentric position in the end of the tube 32.

The support sleeve 50 defines an internal, axial bore 58, and, in the presently preferred embodiment, a back wall 57 with a bore extension hole 59 of smaller diameter than the bore 58. The sleeve 50 has a back end surface 54 and a front end surface 53, the front end surface 53 being oriented substantially perpendicularly to the axis of the support sleeve 50, except for a slight beveled surface 55 on the inside edge of the bore 58.

The arrowhead connector 40 defines a head portion 42, which may be knurled on the outside for easier gripping, a shoulder 44, a body 46, and an extension 48. There is a slight conical surface 45 at the corner of the shoulder 49 and the body 46. The body 46 and extension 48 make up the shank of the arrowhead connector. The body 46 and extension 48 can be the same diameter, or as shown in FIGS. 3, 5 and 6 for the presently preferred embodiment, the extension 48 can be of a smaller diameter than the body 46, such that the extension 48 can slide through the bore extension hole 59 of the support sleeve 50. The diameter of the body 46 is just slightly less than the inside diameter of the support sleeve bore 58, allowing for freedom of axial rotation of the body 46 within the bore 58. Likewise, the extension 48 is slightly smaller than the bore extension hole 59. If the extension 48 and body 46 are of the same diameter, there is no need for a back wall 57 or bore extension hole 59, and the bore 58 can be formed throughout the length of the support sleeve 50.

In the presently preferred embodiment, the extension 48 is longer than the thickness of the back wall 57 so that part of the extension 48 extends past the back end surface 54 of the support sleeve 50. The length of the body 46 is shorter than the length of the bore 58 so that the shoulder 44 may rest against the front end surface 53 of the support sleeve 50 without interference between the body 46 and the back wall 57 of the support sleeve 50. The front end surface 53 of the support sleeve 50 acts as a stop surface or transverse bearing surface. It is conceivable that the body 46 can be made longer than the bore 58, in which case the front face of the back wall 57 of the support sleeve 50 would provide a stop surface or transverse bearing surface.

The shoulder 44 is also oriented substantially perpendicularly to the axis of the arrowhead connector shank, except for the conical surface 45. Thus when the arrowhead connector 40 is inserted within the support sleeve 50, the shoulder 44 of the connector 40 and the front end surface 53 of the sleeve 50 match and help hold the arrowhead 20 in alignment with the arrow shaft 30 at any position of rotation between the arrowhead 20 and arrow shaft 30. The beveled surface 55 and the conical surface 45 also match to help center the connector 40 within the support sleeve 50, improving the alignment.

The beveled surface 55 and conical surface 45 must not be so large as to reduce the flat faces of the front end surface 53 and shoulder 44 to a size so small that they have insufficient bearing surface to convey the thrust forces generated on impact of the arrow. In the alternative, the body 46 and back wall 57 could be designed to convey the thrust forces if the front of back wall 57 were acting as the stop surface, in which case the beveled surface 55 and conical surface 45 could be larger than depicted in FIG. 3.

The arrowhead connector 40 also has, in the presently preferred embodiment, a hollow portion 47 which is partially internally threaded. The arrowhead 20 is shown in FIG. 3 with a shank 26 and external threads 24. The hollow portion 47 of the connector is sized so that the shank 26 and external threads 24 of the arrowhead will screw tightly into it.

It should be noted that the arrowhead can be a broadhead 80 of the old, partially hollow style, as shown in FIG. 5. To use the old style broadhead 80, its central portion 84 is first centered and glued on the ridged portion 92 of a commonly available adapter 90. The shank 96 and threaded end 94 of the adapter 90 can then be screwed into the hollow portion 47 of the connector 40. After being mounted on the adapter 90, the old sytle broadhead 80 is interchangeable with other arrowheads 20 when used with the presently preferred embodiment of the invention.

FIG. 4 shows the preferred method of rotatably and slidably retaining the arrowhead connector 40 within the support sleeve 50. A curved washer 64, or some other type of biasing means such as a spring washer, coil spring or an equivalent, is placed over the end of the connector extension 48. A lock washer 62 or some other fastener is then secured on the extension 48. The curved washer 64 then acts against the lock washer 62 and the back end surface 54 of the support sleeve to bias the arrowhead connector 40 against the stop surface of the support sleeve 50. By forming the support sleeve 50 with a back wall 57 and using an extension 48 of smaller diameter than the body 46, the curved washer 64 and lock washer 62 of the presently preferred embodiment can have smaller inside diameters, and thus have greater strength, than if the diameter of the extension 48 were the same size as that of the body 46.

The position of the lock washer 62 can be adjusted so that the tension in the curved washer 64 provides for the proper degree of freedom of rotation. By clamping the lock washer 62 up further on the extension 48, the curved washer 64 is further compressed. The tension of the curved washer 64 keeps the shoulder 44 of the connector 40 against the front end surface 53 of the support sleeve 50 and the conical surface 45 within the beveled surface 55, thereby maintaining the arrowhead in alignment.

An equivalent though less effective structure incorporating the present invention could be made by placing the biasing means between the shoulder 44 of the connector 40 and the front end surface 53 of the support sleeve 50, thus using the lock washer 62 and the back end surface 54 of the support sleeve 50 as stop surfaces.

In the presently preferred embodiment, the support sleeve 50 and arrowhead connector 40 are formed of aluminum, and the lock washer 62 and washer 64 are formed of a suitable steel. Aluminum provides the necessary strength but is sufficiently light to avoid adding excessive weight to the arrow. The component parts of the presently preferred embodiment must be sized to assure freedom of rotation between the connector 40 and the support sleeve 50, without, however, too much freeplay between the parts, which would adversely affect arrowhead alignment. In the presently preferred embodiment the diameter of the body 46 is about 0.216 inches and the diameter of the bore 58 is about 0.219 inches. The outside diameter of the beveled surface 45 is also about 0.219 inches, so that the connector 40 must be centere before it will completly seat in the sleeve 50. The support sleeve 50 has an overall length of about 0.75 inches and the connector 40 has an overall length of about 1.465 inches.

In practice, an archer using the present invention will procure arrow shafts of the appropriate length and flexibility, or spine. Before inserting the insert of the presently preferred embodiment into the arrow shaft, the archer will position the lock washer 62 and curved washer 64 on the extension 48 for the proper tension, which will depend on the shaft length and spine, bow weight and intended arrowhead weight. The tension on the curved washer 64, and hence the force and friction affecting the degree of freedom of rotation of the arrowhead, will largely be a matter of individual preference and may take some trial and error adjustment to obtain the tension necessary to maintain alignment of arrowheads of the weight normally used by the archer. Thereafter, the support sleeve of the insert, with the arrowhead connector in place inside it, is glued into the end of the archer's shaft. If subsequent adjustments to the tension of the curved washer are desired, the insert must first be unglued. Once the tension is properly adjusted, the insert remains in the shaft and arrowheads can be interchanged as with other, non-rotating inserts.

When an arrow utilizing the preferred embodiment of the present invention is released from the bow, the biasing tension pulls the arrowhead into alignment. During flight, the arrow and arrowhead spin together. Upon penetration, the arrowhead stops spinning, but the arrow shaft continues to spin, with the support sleeve 50 rotating about the shank of the arrowhead connector 40.

Figure 7:
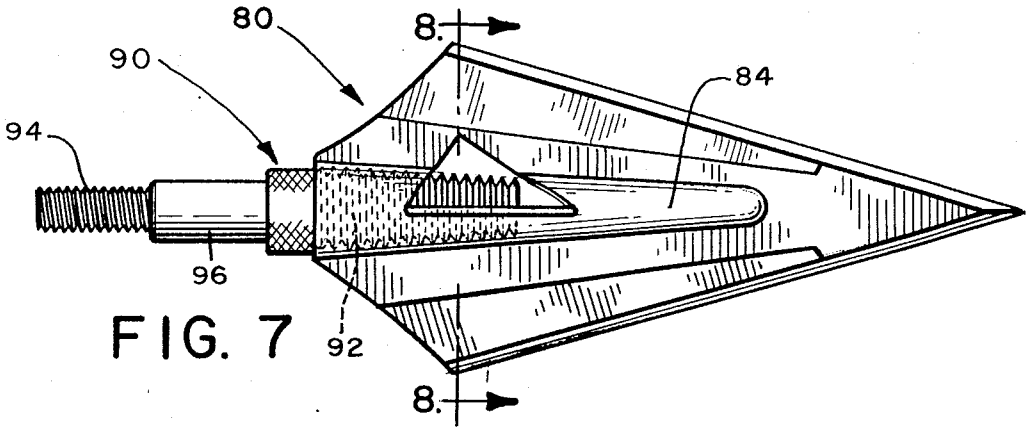
FIG. 7 is a side view of an old style broadhead mounted on an adapter suitable for use with the preferred embodiment of FIG. 1.

If the archer wants to change arrowheads, either in switching between target practice and hunting, or to replace a broadhead with dull blades, or for any other reason, the archer simply unscrews the arrowhead 20 from the connector 40, which remains rotatably mounted within the support sleeve 50. Old style broadheads 80 of the type shown in FIG. 7 can be used with the presently preferred embodiment of the present invention simply by first attaching them to a well known adapter 90, commonly available.

The advantages of the present invention are manyfold. First, the apparatus of the present invention can be used instead of the standard insert and make any type of arrowhead a rotatable arrowhead. Second, the biasing tension provided by the spring 64 maintains arrowhead alignment. Third, the tension on the biasing means is adjustable, so that an archer using a heavy arrowhead can maintain the alignment of the arrowhead by tightening the tension, reducing the degree of rotational freedom without eliminating it altogether. Fourth, the biasing tension acts to realign the arrowhead after the arrow has been released from the bow and the arrowhead has been whipped. Fifth, the biasing tension reduces the noise made by the parts of the arrowhead connecting apparatus rattling together. Preventing this rattling noise is especially important when hunting if the archer's arrow supply is bow mounted. This is because vibration of the bow on release of the arrow induces vibration in the bow mounted arrows, and the sound of rattling parts may alert the intended prey.

An additional advantage of the presently preferred embodiment is that an archer with shafts used for target practice will not have to purchase additional and longer shafts for hunting with broadheads. This advantage relates to the fact that an experienced archer draws the bow to the same position each time an arrow is shot. Target arrowheads do not have blades, so the archer can draw the arrow back almost until the connection between the arrow shaft and arrowhead reaches the bow. Using bladed arrowheads, however, the archer generally uses a slightly longer arrow shaft so that when the arrow is pulled back to the archer's normal position the blades are about a half-inch or more in front of the bow, thus preventing the blades from injuring the hand holding the bow. With the preferred embodiment of the present invention, an archer with short shafts used for target practice will not have to purchase longer shafts for hunting because the head 42 of the arrowhead connector 40 adds a half-inch or so to the effective length of the arrow shaft 30.

The present invention has been described in detail for purposes of illustration, and is not limited thereby but is defined in the following claims, including all equivalents.

I claim:

1. In an arrow comprising an arrow shaft and an arrowhead, an improved apparatus for rotatably mounting the arrowhead on the arrow shaft wherein the improvement comprises:

(a) a support sleeve disposed in a concentric fixed relation at one end of the arrow shaft, said support sleeve having a stop surface and a back end surface;

(b) an arrowhead connector releasably attachable to the arrowhead;

(c) means for axially retaining the arrowhead connector slideably and rotatably within the support sleeve; and (d) means interposed between the back end surface of the support sleeve and the axial retaining means for resiliently biasing the arrowhead connector against the stop surface of the support sleeve.

2. The improved apparatus of claim 1 wherein the resilient biasing means is adjustable to produce an adjustable biasing force.

3. An apparatus for mounting an arrowhead on a front hollow end of a arrow shaft, the apparatus comprising:

(a) a support sleeve sized to be concentrically secured in the front hollow end of the arrow shaft, said support sleeve having a front end surface, a back end surface and a flange shaped to bear against the front hollow end of the arrow shaft;

(b) an arrowhead connector, said connector having shoulder and a shank portion, said shank being longer than and rotatably and slideably extending through said support sleeve;

(c) securing means attached to the connector shank at a position behind the back end surface of the support sleeve; and (d) resilient biasing means interposed between the securing means and the back end surface of the support sleeve for resiliently biasing the shoulder of the connector against the front end surface of the support sleeve.

4. The apparatus of claim 3 wherein the arrowhead connector comprises an internally threaded portion for receiving an externally threaded shank of an arrowhead.

5. The apparatus of claim 3 wherein the arrowhead comprises a partially hollow arrowhead secured to an adapter and wherein the arrowhead connector is releasably attachable to the adapter.

6. The apparatus of claim 3 wherein the biasing means comprises a curved washer interposed between the back end surface of the support sleeve and the retaining means.

7. The apparatus of claim 3 wherein the biasing means comprises a spring washer interposed between the back end surface of the support sleeve and the retaining means.

8. The apparatus of claim 3 wherein the biasing means comprises a coil spring interposed between the back end surface of the support sleeve and the retaining means.

9. An arrow shaft insert for use with an arrow of the type which comprises an arrowhead comprising an externally threaded shank portion for mounting the arrowhead and an arrow shaft comprising a shaft with a hollow end, said insert comprising:

(a) a support sleeve comprising an internal bore, a flanged front end configured to bear against the hollow end surface of the arrow shaft, a back end surface, and a scored outside surface sized to fit tightly within the hollow end of the arrow shaft;

(b) an arrowhead connector comprising a head, shoulder, body and extension such that the body slideably fits within the support sleeve, the extension extends beyond the back end surface of the support sleeve and the shoulder fits over the flanged front end of the support sleeve with the head in front of the flanged front end;

(c) the arrowhead connector also comprising an internally threaded portion sized for receiving the arrowhead shank portion;

(d) means for retaining the arrowhead connector within the support sleeve; and (e) means interposed between the back end surface of the support sleeve and the retaining means for resiliently biasing the shoulder of the arrowhead connector against the support sleeve flanged front end.

10. The arrow shaft insert of claim 9 wherein the retaining means is secured on the extension of the arrowhead connector in a position behind the back end surface of the support sleeve.

11. The arrow shaft insert of claim 10 wherein the retaining means comprises a lock wasner.

12. The arrow shaft insert of claim 10 wherein the resiliently biasing means comprises a curved washer interposed between the back end surface of the support sleeve and the retaining means.

13. The arrow shaft insert of claim 10 wherein the resiliently biasing means comprises a spring washer interposed between the back end surface of the support sleeve and the retaining means.

14. The arrow shaft insert of claim 10 wherein the resilient biasing means comprises a coil spring interposed between the back end surface of the support sleeve and the retaining means.

15. The arrow shaft insert of claim 9 wherein the support sleeve further defines a bacx wall and a bore extension hole of smaller diameter than the bore and wherein the arrowhead connector extension is of a smaller diameter than the arrowhead connector body and the connector is configured such that the extension fits through and extends beyond the bore extension hole.

16. The arrow shaft insert of claim 9 wherein the resilient biasing means exerts a force of adjustable magnitude.

17. The arrow shaft insert of claim 9 wherein:

(a) the support sleeve further comprises a beveled surface adjacent to the internal bore and the flanged front end;

(b) the arrowhead connector further comprises a conical surface adjacent to the shoulder and the body; and (c) the beveled surface and conical surface cooperating to align the arrowhead connector retained within the support sleeve.

* * * * *

UNITED STATES PATENT AND TRADEMARK OFFICE

CERTIFICATE OF CORRECTION

PATENT NO. : 4,671,517

DATED : June 9, 1987

INVENTOR(S) : Danny J. Winters

It is certified that error appears in the above-identified patent and that said Letters Patent is hereby corrected as shown below:

IN THE SUMMARY OF THE INVENTION

In column 2, line 28, please insert a comma (,) after the word "shaft";

In column 2, line 29, please delete "the op degree" and substitute therefor --the optimum degree--.

IN THE DETAILED DESCRIPTION OF THE PREFERRED EMBODIMENTS

In column 4, line 28, please delete "sytle" and substitute therefor --style--;

In column 5, line 12, please delete "centere" and substitute therefor --centered--;

In column 5, line 12, please delete "completly" and substitute therefor --completely--.

UNITED STATES PATENT AND TRADEMARK OFFICE

CERTIFICATE OF CORRECTION

PATENT NO. : 4,671,517

DATED : June 9, 1987

INVENTOR(S) : Danny J. Winters

It is certified that error appears in the above-identified patent and that said Letters Patent is hereby corrected as shown below:

IN THE CLAIMS

In Claim 11 (column 8, line 11), please delete "wasner" and substitute therefor --washer--;

In Claim 15 (column 8, line 25), please delete "bacx" and substitute therefor --back--.

Signed and Sealed this

Tenth Day of May, 1988

*Attest:*

DONALD J. QUIGG

*Attesting Officer*

*Commissioner of Patents and Trademarks*